United States Patent [19]

Järund

[11] 4,345,415

[45] Aug. 24, 1982

[54] METHOD FOR THE MANUFACTURE OF PACKAGES FOR DRINKING STRAWS

[75] Inventor: Erik Järund, Morhult, Sweden

[73] Assignee: Tetra Pak International AB, Lund, Sweden

[21] Appl. No.: 151,728

[22] Filed: May 20, 1980

[30] Foreign Application Priority Data

May 23, 1979 [SE] Sweden ..... 7904547

[51] Int. Cl.[3] ..... B65B 9/02

[52] U.S. Cl. ..... 53/450; 156/251; 156/267; 493/342; 493/373

[58] Field of Search ..... 53/296–298, 53/372, 373, 450, 453, 546, 548, 550, 552–555, 559, 591; 83/31; 156/251, 267, 515; 206/820; 493/77, 82, 83, 342, 373, 381

[56] References Cited

U.S. PATENT DOCUMENTS

| | | | |
|---|---|---|---|
| 1,830,571 | 11/1931 | Süllwald | 53/450 X |
| 3,333,393 | 8/1967 | Sparks | 53/450 X |
| 3,372,797 | 3/1968 | Grevich | 53/552 X |
| 3,482,733 | 12/1969 | Groves | 206/820 X |
| 3,589,913 | 6/1971 | Rosenberg | 53/552 X |
| 3,991,540 | 11/1976 | Ballestrazzi et al. | 53/554 X |
| 4,153,496 | 5/1979 | Swift | 156/267 X |
| 4,246,058 | 1/1981 | Reed | 156/267 X |

*Primary Examiner*—R. L. Spruill
*Assistant Examiner*—Charles L. Willis
*Attorney, Agent, or Firm*—Burns, Doane, Swecker & Mathis

[57] ABSTRACT

In accordance with the present invention protective envelopes for suction tubes or drinking straws as well as the tapes joining them are manufactured at the same time and of the same material. The suction tubes are placed with equal intervals transversely between two thermoplastic webs, whereupon these webs are sealed to each other around the suction tubes. At the same time the webs are punched or cut so that individual suction tube envelopes are obtained which are mutually connected by means of straps extending between the envelopes. In this manner all handling of separate wrapped suction tubes is avoided, so that the suction tube band can be manufactured with appreciably greater precision. The invention relates to the method of manufacture as well as to a machine for its realization and the finished suction tube band.

4 Claims, 2 Drawing Figures

METHOD FOR THE MANUFACTURE OF PACKAGES FOR DRINKING STRAWS

BACKGROUND AND SUMMARY OF THE PRESENT INVENTION

The present invention relates to a method for the manufacture of bandlike coherent packages for suction tubes, i.e., elongated hollow members such as drinking straws, and to an arrangement for the manufacture of the bandlike coherent packages and packages manufactured in accordance with the method.

Bandlike coherent suction tubes wrapped in individual protective envelopes are used inter alia in those cases where one or more suction tubes are to be applied to the outside of non-returnable packages for fruit juice, milk etc. Packing containers of this type and arrangements for application of the suction tubes are described in Swedish patent application No. 7801067-5 which corresponds to U.S. Pat. No. 4,293,369, to which reference is made. The bandlike coherent packed suction tubes make it possible with assurance to apply a wrapped suction tube in the correct position to the outside of each individual packing container. Previously this has not been possible, since loose suction tubes wrapped in separate envelopes, owing to their low weight and their flexible, undefined outer contours, could not easily be brought by mechanical means into their correct position on the packing container.

Bandlike coherent suction tubes wrapped in protective envelopes, for the suction tube applicator described in the abovementioned Swedish patent application, up to now comprised suction tubes which were wrapped in protective envelopes of thin paper material and were joined in a rope-ladderlike manner with the help of adhesive tapes, which were attached in pairs and mutually parallel in the vicinity of the two outer ends of the suction tube envelopes. This type of suction tube band can be manufactured at a high rate, but here too the handling of the suction tubes wrapped in the protective envelopes causes certain difficulties, especially with regard to the placing of the wrapped suction tubes in correct mutual position on the adhesive tapes.

It is therefore an object of the present invention to eliminate the need for mechanical handling of individual suction tubes wrapped in the protective envelopes, since such handling, owing to the undefined and indeterminate contours of the protective envelopes, presents great difficulties.

It is thus an object of the present invention to overcome the abovementioned disadvantages and to provide a method for the manufacture of coherent bands with suction tubes wrapped in individual protective envelopes, which method ensures great accuracy and is suitable for rapid mechanical manufacture.

The above-mentioned object and others have been achieved in that the protective envelopes as well as the parts joining the protective envelopes are manufactured at the same time and of the same material. More particularly, the object mentioned above has been achieved in accordance with the present invention in that a method for the manufacture of bandlike coherent packages for suction tubes has been given the characteristic that the suction tubes are placed transversely between two material webs which are sealed to one another around each suction tube to form closed protective envelopes. Portions of the material webs located between the suction tubes are removed so that the protective envelopes are joined together along limited parts of their peripheral edges.

It is a further object of the present invention to provide an arrangement for the manufacture of bandlike coherent packages for suction tubes, which arrangement is simple and uncomplicated and makes possible rapid and accurate manufacture.

These and other objects have been achieved in accordance with the invention in that an arrangement for the manufacture of bandlike coherent packages for suction tubes in accordance with the method in accordance with the invention has been given the characteristic that the arrangement comprises elements for advancing and guiding of two material webs. Units are provided for placing of the suction tubes between the two webs. Sealing and punching elements are provided for sealing of the material webs to each other around the suction tubes and for separation of parts of the material webs situated between the suction tubes.

Still further, it is an object of the present invention to provide a suction tube band which is suitable for manufacture in accordance with the invention and which is adapted for safe utilization in the suction tube applicator mentioned in the introduction.

This object and others have been achieved in accordance with the invention in that a suction tube band comprising bandlike coherent packages with suction tubes which are individually packed in protective envelopes arranged transversely in relation to the longitudinal direction of the band, has been given the characteristic that the protective envelopes are connected to each other along parts of their peripheral edges so as to form a coherent band of suction tube packages arranged at intervals.

BRIEF DESCRIPTION OF THE DRAWINGS

A preferred embodiment of the invention will now be described in detail with special reference to the enclosed schematic drawing which only illustrates the parts necessary for the understanding of the invention.

DETAILED DESCRIPTION OF THE PREFERRED EMBODIMENTS

Figure 1:
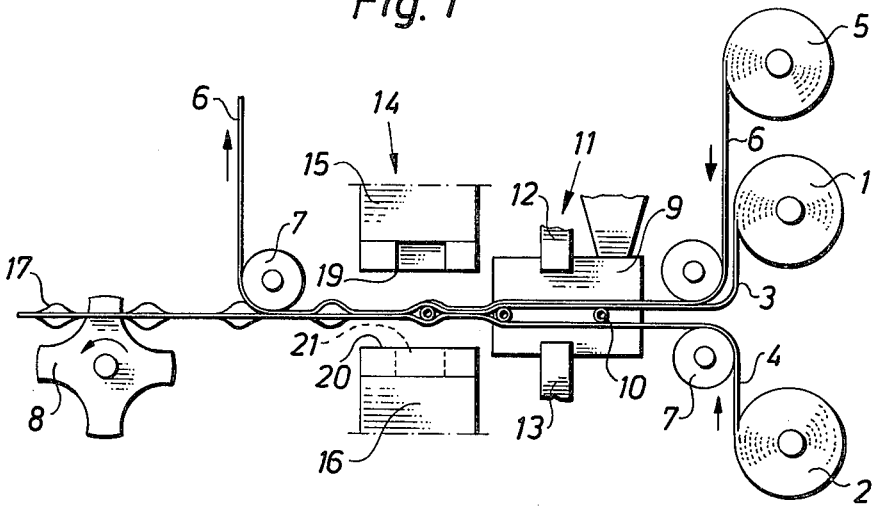
FIG. 1 is a side view partially in section of an arrangement for the realization of the method in accordance with the invention.

The arrangement in accordance with the invention consists of a number of machine elements supported on a machine stand (not shown) for the conversion of separate material strips and suction tubes to a suction tube band comprising bandlike coherent packages for suction tubes. The machine comprises two magazine rolls 1, 2 for material webs 3 and 4 respectively, preferably of thermoplastic material, and a further magazine roll 5 for a material strip 6 of fibrous material. The machine also comprises a great number of guide rollers 7 (only a few of which are shown) for the guiding of the different material webs and material strips past the different processing stations in the machine, as well as a driving arrangement in the form of a driving device 8 actuated by a motor (not shown), which in a sprocketlike manner engages with the finished suction tube band and drives the same in the direction from right to left in FIG. 1.

The machine comprises three different processing stations which the material webs 3, 4 and the material strip 6 pass. At the inlet end of the machine, that is to say, on the righthand side of the machine in FIG. 1, there is a feeding device 9 adapted to supply and feed suction tubes or drinking straws 10 between the parallel running material webs 3, 4. The feeding unit 9 comprises a magazine for suction tubes and a reciprocating element for putting the suction tubes 10 in correct position between the two material webs.

At the same level as the feeding device 9 for suction tubes a sealing element 11 is provided which comprises a sealing jaw 12 and a counter-jaw 13 situated on opposite sides of the material webs 3, 4. The two jaws are displaceable by means of pneumatic elements (not shown) in the direction towards one another so as to lie against the suction tube band. The jaws can be pressed with a given, controllable force against each other and the material webs situated between them. The sealing jaw 12 can be heated by means of electric resistance elements to the desired temperature.

After the sealing element 11 a further sealing and punching element 14 is provided which also consists of two parts arranged on either side of the suction tube band, namely a thermal punch 15 and a holding-up tool 16, which are displaceable so as to rest against one another with the suction tube band 17 situated between them. The working surface of the thermal punch 15 facing the suction tube band 17 is profiled and comprises recessed as well as raised linear zones or heated knives 19, which are heatable and form the actual working surface of the thermal punch 15. The heated knives 19 are preferably four in number and comprise two substantially U-shaped knives situated at the two ends of the elongated punch 15 and two linear knives situated substantially centrally between them and comprising short end parts set at an angle. The knives on repeated punching jointly form a pattern which corresponds to an outer contour of protective envelopes which form the finished suction tube band 17, that is to say, a wavy boundary line along the two longitudinal sides of the suction tube band and substantially rectangular openings situated between the suction tubes. It should be pointed out that the knives lack cutting edges proper and that the operation which is carried out is a thermal punching in the thermoplastic material webs 3, 4. The material strip 6 is thus not broken up, as will be explained in more detail in the following. The holding-up tool 16 has a substantially plane working surface 20, wherein a recess 21 is provided which is adapted to take up the suction tube 10 when the holding-up tool 16 and the thermal punch 15 are pressed against the suction tube band 17 from either side.

After the sealing and punching unit 14 the arrangement in accordance with the invention is provided with a further guide roller 7 and the driving element 8 mentioned earlier for the driving of the suction tube band. It is understood that the arrangement in accordance with the invention comprises a number of further details which are necessary for the achievement of a complete, working machine, e.g. driving elements, power supply elements and pneumatic devices. However, these are conventional, of a type known to the expert, and do not form a part of the present invention.

It should also be evident that it is possible to double or multiply at will any of the elements, if a machine with a higher working capacity is desirable. For example, the feeding device 9 may supply, by means of a multi-fingered, forklike device, a number of suction tubes (e.g. 4) at one time between the webs, and likewise a multiple sealing device 11, by means of several pairs of jaws, sealing the webs to each other between the suction tubes, while the tubes are still retained in position by means of the forklike device.

Figure 2:
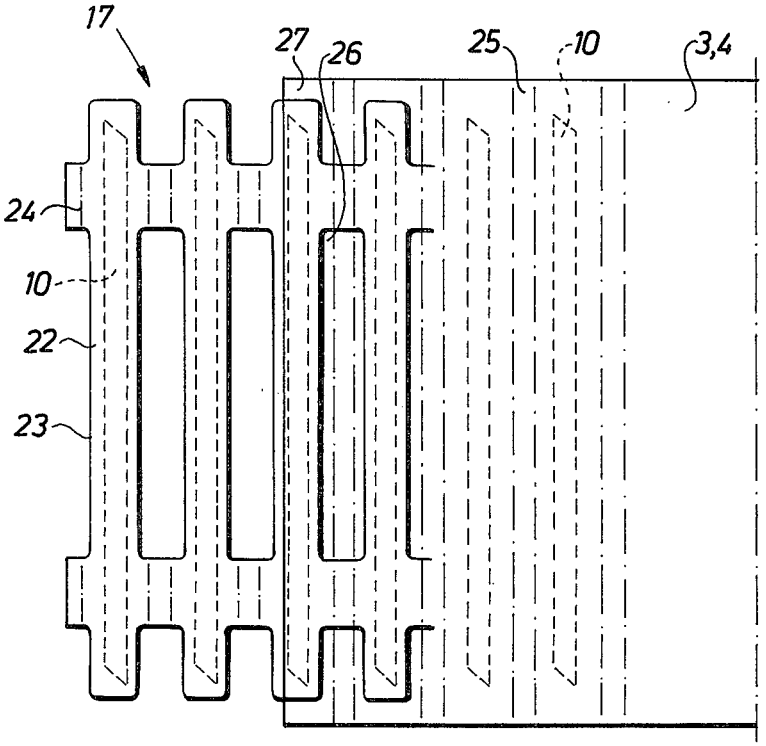
FIG. 2 is a top view of a suction tube band as the band proceeds through a manufacturing process in accordance with the invention.

With reference to FIG. 2, a suction tube band 17 is formed by the successive conversion of the separate material webs 3, 4 and the suction tubes 10 (shown in FIG. 1) to a finished suction tube band. The finished suction tube band 17 (shown on the left in FIG. 2) comprises a number of suction tubes 10 which are individually wrapped in protective envelopes 22, which at limited parts of their peripheral edges 23 are joined to one another with the help of integrated bands or straps 24. The straps 24 are arranged at some distance from one another and are manufactured in one piece with the protective envelopes, that is to say formed from the material webs 3, 4. Each suction tube 10 is thus enclosed in a protective envelope 22 which consists of parts of the two material webs 3, 4 adapted to the form of the suction tube which are sealed to each other, whereupon the unused parts of the material webs are cut off and removed.

The manufacture of the suction tube band in accordance with the invention will now be described in detail with special reference to FIG. 2, where the course of manufacture is illustrated from right to left. Farthest to the right, the suction tube 10 is placed between the material webs 3, 4 running parallel. On the side of the material web 3 remote from the material web 4 also runs the material strip 6, whose width corresponds to the width of the material webs 3, 4. When the material webs 3, 4 and the material strip 6 have been provided, with the help of the feeding device 9, with suction tubes 10 arranged transversely at uniform intervals, the webs 3, 4 and the material strip 6 approach the sealing element 11, the two working jaws of which press the material webs against each other with simultaneous supply of heat, so that the two material webs 3, 4 are heat-sealed to each other in transverse sealing regions 25 which are situated just halfway between the inserted suction tubes 10. Thus the suction tubes are fixed in correct position between the material webs. At the same time as the two material webs 3, 4 are sealed to each other, the material strip 6 is also joined to the upper material web 3 owing to the plastic material, softened through the heat supplied, partly penetrating into and bonding to the surface of the material strip.

After the sealing, the suction tube band 17 is advanced further to the next processing station where the material webs are processed with the help of sealing and punching elements 14. The thermal punch 15 now comes to rest against the suction tube band (actually the material strip 6) and the raised knives 19 of the punch, after heating, will seal the two material webs 3, 4 to each other along a sealing line extending around the suction tube which corresponds to the peripheral edge 23 of each protective envelope 22. At the same time as the sealing, certain parts of the material webs 3, 4 will be cut off along the sealing lines, namely a rectangular area 26 situated between the suction tubes and material areas 27 situated at the two end regions of the suction tubes. In this way not only will individual protective envelopes 22 be formed, but also the straps 24 connecting the protective envelopes. By the thermal punching the said material areas 26, 27 will be separated from the material webs 3, 4, so that they can be removed from the finished suction tube band 17. The material strip 6 (of fibrous material) is not affected by the thermal punching, and the parts punched out can now be removed with the help of the material strip 6 which, as mentioned previously is attached in the sealing region 25 to the material webs 3, 4. In other words, the material strip 6, when it is removed from the finished suction tube band 17, will carry with it the punched-out waste material portions 26, 27 which appreciably facilitates the automatic manufacture by taking care of the waste material. The material strip 6 is also connected within limited parts of the sealing region 25 to the straps 24 of the suction tube band 17, but since the material strip 6 that is manufactured of paper is retained only with a relatively weak adhesion force on the thermoplastic web, the strip 6 can be detached from the straps 24 without damaging the same. If required, the material strip may be prepared with a somewhat adhesion-reducing medium, so as to prevent a strong attachment in the region of the straps 24.

After the waste material and the material strip 6 have been removed, the suction tube band is ready for feeding into a suction tube applicator of the type which has been described in the patent application mentioned earlier, wherein the applicator separates the suction tubes wrapped in the individual protective envelopes 22 by cutting transversely through the sealed region of the straps 24. Since the sealing region 25 extending over the straps 24 is of a relatively great width, the tightness of the individual protective envelopes 22 is retained, even if the cutting off of the straps 24 does not occur exactly halfway between two suction tubes, which tightness of course is a precondition for the protective envelopes retaining their protective function.

The two material webs 3, 4 which together form the finished suction tube band, consist of heat-sealable material, e.g. polyethylene. The material strip 6 whose task is to facilitate a rapid and effective taking care of and a simplified further handling of the waste material, which arises in the manufacture of the suction tube band, is made appropriately of a cheap fibrous material, e.g. thick paper material. Such a fibrous material also makes it possible to achieve by means of heat the temporary seal between the material strip 6 and the material web 3 which is required, at the same time as the material strip prevents the thermoplastic layer from sticking to the heated sealing and punching elements. It is of course also possible to utilize a material strip of a different material, e.g. a material which is coated with a heatactivable binder.

The method in accordance with the invention naturally can also be simplified in that the material strip 6 is left out, and the punched out parts of the material webs 3, 4 forming the suction tube band are taken charge of in a different manner, e.g. with the help of vacuum ducts, mechanical gripping elements or the like. This, however, entails the loss of a great advantage of the invention, namely the possibility of providing a safe and accurate manufacture, even at a high speed, since individual handling of the punched out parts would be possible only at a relatively low rate of production. Furthermore, there is a great risk of the plastic material attaching itself to the punching tools, so that the latter have to be coated with tetrafluoroethylene.

The different processing tools of the machine are stationary in the described embodiment of the machine, that is to say, they are not movable in the longitudinal direction of the suction tube band. This implies a simple construction of the machine, but makes it necessary to advance the suction tube band intermittently. If a higher rate of manufacture is desirable, it is of course possible to provide the suction tube band with a continuous feed, which means that the processing tools during their active period have to be moved in a working stroke together with the suction tube band and at the speed of the latter. After each completed sealing, punching etc the processing tools are then moved in a rapid return stroke back to the starting position, whereupon a new working stroke is started immediately. This construction implies an appreciably higher rate of manufacture than the preferred embodiment described and may be preferred therefore in cases where the higher speed justifies the more complicated design of the machine and the higher cost. The construction may be realized in practice in that the processing tools employed are fitted onto a slide arranged parallel with the suction tube band and are connected to a suitable reciprocating driving element. As such constructions are known to those versed in the art, a more detailed description will not be undertaken.

The suction tube band 17 produced possesses great accuracy and is therefore well suited for use in automatic machines for application of suction tubes to packing containers. It is a further advantage of the suction tube band that it is manufactured in its entirety of plastic material, which on the one hand eliminates the need for loose (and expensive) adhesive tapes and on the other hand ensures that the suction tube band has a good resistance to mechanical stresses in dry as well as in wet condition, which is advantageous since the packages provided with applied suction tubes are stored in moist surroundings, e.g. in a cold room or refrigerator. The suction tube band also has good flexibility which makes it possible to store the band in rolled up form.

The principles, preferred embodiments and modes of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the invention. Accordingly, it is expressly intended that all such variations and changes which fall within the spirit and the scope of the present invention as defined in the appended claims be embraced thereby.

What is claimed is:

1. A method for the manufacture of bandlike coherent packages for drinking straws, comprising the steps of placing a plurality of drinking straws transversely between two material webs constituted of thermoplastic films, heat sealing the two material webs to one another around each drinking straw to form closed protective envelopes, heat-sealing a material strip to a side of one of the films remote from the drinking straws, thereby creating transverse sealing regions situated between the drinking straws, removing portions of the sealing regions from the material webs located between the drinking straws together with the material strip so that the protective envelopes are joined together only along limited portions of their peripheral edges.

2. A method in accordance with claim 1, further comprising the steps of removing the portions of the two material webs by thermal punching along peripheral edges of the protective envelopes, and sealing the material webs at the same time to each other along the said edges.

3. A method in accordance with claim 2, wherein the material strip consists of paper.

4. A method in accordance with claim 1, wherein the material webs consist of polyethylene.

* * * * *